US011771941B2

(12) United States Patent
Luo et al.

(10) Patent No.: US 11,771,941 B2
(45) Date of Patent: Oct. 3, 2023

(54) WEIGHT ADJUSTABLE DUMBBELL

(71) Applicant: Jiangxi EQI Industrial Co. Ltd, Jiujiang (CN)

(72) Inventors: Xietong Luo, Jiangxi (CN); Zhanfei He, Jiangxi (CN)

(73) Assignee: Jiangxi EQI Industrial Co. Ltd, Jiujiang (CN)

( * ) Notice: Subject to any disclaimer, the term of this patent is extended or adjusted under 35 U.S.C. 154(b) by 227 days.

(21) Appl. No.: 17/510,377

(22) Filed: Oct. 25, 2021

(65) Prior Publication Data

US 2023/0031956 A1 Feb. 2, 2023

(30) Foreign Application Priority Data

Aug. 2, 2021 (CN) ..... 202110883244.9
Aug. 2, 2021 (CN) ..... 202121786570.X
(Continued)

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01)

(58) Field of Classification Search
CPC ..... A63B 21/0726; A63B 21/072–075
See application file for complete search history.

(56) References Cited

U.S. PATENT DOCUMENTS 11,167,167 B1 * 11/2021 Weng ..... A63B 21/0726
2007/0184945 A1 * 8/2007 Lin ..... A63B 21/075 482/107
(Continued)

FOREIGN PATENT DOCUMENTS

CN 102019064 A 4/2011
CN 111672057 A 9/2020
(Continued)

OTHER PUBLICATIONS

Translation of CN212282678 (Year: 2021).*
(Continued)

*Primary Examiner* — Joshua Lee
*Assistant Examiner* — Catrina A Letterman
(74) *Attorney, Agent, or Firm* — Andrew C. Cheng

(57) ABSTRACT

A weight adjustable dumbbell includes a handle and a first counterweight part and a second counterweight part respectively arranged at two ends of the handle. Each of the first counterweight part and the second counterweight part includes a plurality of dumbbell pieces. Each dumbbell piece includes a mounting hole. The weight adjustable dumbbell further includes an adjusting mechanism. The adjusting mechanism includes a rotating mechanism, a transmission shaft, a first transmission sleeve and a second transmission sleeve. The transmission shaft can drive the first transmission sleeve and the second transmission sleeve to move axially along the transmission shaft and cause distal ends of the first transmission sleeve and the second transmission sleeve to insert into or leave the mounting holes of portion or all of the dumbbell pieces, whereby the dumbbell pieces are fixed on or detached from the first counterweight part and the second counterweight part.

19 Claims, 3 Drawing Sheets

(30) Foreign Application Priority Data

Aug. 2, 2021 (CN) ..... 202121786582.2
Aug. 2, 2021 (CN) ..... 202121786687.8

(56) References Cited

U.S. PATENT DOCUMENTS

| | | | | |
|---|---|---|---|---|
| 2007/0254785 | A1* | 11/2007 | Lin | A63B 21/0728 482/108 |
| 2015/0367163 | A1 | 12/2015 | Moran et al. | |
| 2022/0193482 | A1* | 6/2022 | Wu | A63B 21/0726 |
| 2022/0331641 | A1* | 10/2022 | Weng | A63B 21/075 |

FOREIGN PATENT DOCUMENTS

| | | | | |
|---|---|---|---|---|
| CN | 212282678 | * | 1/2021 | A63B 21/075 |
| CN | 213031755 U | | 4/2021 | |
| CN | 213131743 | * | 5/2021 | A63B 21/072 |
| CN | 213131743 U | | 5/2021 | |
| CN | 213131749 U | | 5/2021 | |

OTHER PUBLICATIONS

Translation of CN213131743 (Year: 2021).*
European Search Report of EP application No. 21204277.4 dated Apr. 13, 2022.
CN Search Report of CN application No. 202110883244.9 dated Mar. 22, 2022.
CN First Office Action of CN application No. 202110883244.9 dated Mar. 22, 2022.

* cited by examiner

WEIGHT ADJUSTABLE DUMBBELL

CROSS-REFERENCE TO RELATED APPLICATIONS

The present invention is based on and claims the priority of Chinese patent application Nos. 202110883244.9, 202121786687.8, 202121786582.2 and 202121786570.X, which are filed on Aug. 2, 2021. The contents of the above-identified applications are incorporated herein by reference.

TECHNICAL FIELD

The present invention relates to the technical field of fitness articles, and in particular, to a weight adjustable dumbbell.

BACKGROUND OF THE INVENTION

Currently, there are some weight adjustable dumbbells on the market, which can solve the problem that the weight of the previous integrated dumbbell cannot be adjusted. However, at present, the operation of these weight adjustable dumbbells is cumbersome, which cannot satisfy the user and has a poor use experience.

The foregoing description is intended to provide general background information and does not necessarily constitute the prior art.

SUMMARY OF THE INVENTION

In view of the above, the present invention provides a weight adjustable dumbbell, which is convenient for operation by the user.

The present invention provides a weight adjustable dumbbell comprising a handle assembly, wherein the handle assembly comprises a handle and a first counterweight part and a second counterweight part respectively arranged at two ends of the handle, each of the first counterweight part and the second counterweight part comprises a plurality of dumbbell pieces, each dumbbell piece comprises a mounting hole and an open groove extending from the mounting hole to an edge of the dumbbell piece, a width of the open groove is less than a diameter of the mounting hole;

the weight adjustable dumbbell further comprises an adjusting mechanism, the adjusting mechanism comprises a rotating mechanism, a transmission shaft, a first transmission sleeve and a second transmission sleeve, the rotating mechanism is arranged on an outer side of the first counterweight part, the rotating mechanism is fixedly connected with the transmission shaft to drive the transmission shaft to rotate; and an outer diameter of the first transmission sleeve and the second transmission sleeve is greater than the width of the open groove but less than the diameter of the mounting hole, the first transmission sleeve and the second transmission sleeve are sleeved on the transmission shaft, and the transmission shaft is meshed with the first transmission sleeve and the second transmission sleeve, such that the transmission shaft can drive the first transmission sleeve and the second transmission sleeve to move axially along the transmission shaft and cause distal ends of the first transmission sleeve and the second transmission sleeve to insert into or leave the mounting holes of portion or all of the dumbbell pieces, whereby the dumbbell pieces are fixed on or detached from the first counterweight part and the second counterweight part.

Further, the transmission shaft is a screw rod, the first transmission sleeve and the second transmission sleeve are screw nuts respectively, two ends of the screw rod are provided with an external thread, an interior of each of the screw nuts is provided with an internal thread matched with the external thread, wherein the thread directions of the two internal threads are opposite.

Further, a planetary gear transmission mechanism is used as the rotating mechanism, the planetary gear transmission mechanism comprises a ring gear, a sun gear and a planetary gear which are meshed with each other, the ring gear is used for operating, the sun gear is fixedly connected with the transmission shaft, such that the ring gear drives the transmission shaft to rotate through the sun gear.

Further, the adjusting mechanism further comprises an operating member, the operating member is fixedly connected with the ring gear, such that the ring gear is driven to rotate by rotating the operating member.

Further, an outer periphery of the operating member is provided with a plurality of scales to indicate the dumbbell weights corresponding to different positions of the operating member.

Further, the ring gear rotates one turn, the first transmission sleeve and the second transmission sleeve axially move multiples of a distance between the centers of two adjacent dumbbell pieces.

Further, the handle is a hollow structure, the transmission shaft, the first transmission sleeve and the second transmission sleeve are located inside the handle.

Further, the first transmission sleeve and the second transmission sleeve are provided with an anti-rotation structure, such that when driven by the transmission shaft, the first transmission sleeve and the second transmission sleeve can move only axially along the transmission shaft due to the limitation of the anti-rotation structure.

Further, the anti-rotation structure comprises anti-rotation strips respectively provided on an outer periphery of the first transmission sleeve and the second transmission sleeve, the handle is internally provided with anti-rotation grooves, the first transmission sleeve and the second transmission sleeve are prevented from rotating with the transmission shaft through the cooperation between the anti-rotation grooves and the anti-rotation strips.

Further, an annular groove is provided at a middle position of the transmission shaft, a stopper is fixed to the handle, and the stopper is engaged in the annular groove, such that the transmission shaft can rotate relative to the handle but cannot move axially.

Further, the weight adjustable dumbbell further comprises a prompt mechanism arranged on an outer side of the second counterweight part, the prompt mechanism comprises a fixed element, an elastic element, a ball and a rotating element, the rotating element is fixed to the transmission shaft and rotates with the transmission shaft, the rotating element is provided with a plurality of holes, the ball is located on a rotation path of the holes, the ball is pushed by the elastic element and movably installed on the fixed element, when the dumbbell is adjusted to a predetermined weight, the ball is pushed into one of the holes by the elastic element.

Further, the fixed element is fixedly provided with a tube, the ball is installed to an outer end of the tube, the elastic element is received in the tube and located between the ball and the fixed element, and pushes the ball to move outward from the outer end of the tube, such that the ball is movably installed on the fixed element.

Further, the weight adjustable dumbbell further comprises a base seat for placing the handle assembly and a self-locking mechanism arranged on an outer side of the second counterweight part, the self-locking mechanism comprises a rotating element, a locking member and an elastic member, the rotating element is fixed to the transmission shaft and rotates with the transmission shaft, the rotating element is a circular plate with a plurality of locking grooves distributed around a periphery thereof, the locking member comprises an upper locking portion and a lower resisting portion, the locking member is rotatably mounted on a fixed element, the elastic member is arranged between the locking member and the fixed element, such that the elastic member can drive the upper locking portion to rotate inward to be engaged with the locking groove; and when the handle assembly is placed on the base seat, the lower resisting portion is resisted by the base seat to drive the upper locking portion to rotate outward, such that the upper locking portion is disengaged from the locking groove.

Further, the first counterweight part comprises a first dumbbell piece mounting base for fixing the dumbbell pieces thereon, the first dumbbell piece mounting base comprises a first outer baffle;

the second counterweight part comprises a second dumbbell piece mounting base for fixing the dumbbell pieces thereon, the second dumbbell piece mounting base comprises a second outer baffle; and the second outer baffle is used as the fixed element.

Further, the first dumbbell piece mounting base further comprises a first spacer and a second spacer fixed on an inner side of the first outer baffle, the first spacer and the second spacer are provided with a plurality of first recesses used to separate and limit the dumbbell pieces fixed on the first dumbbell piece mounting base; and the second dumbbell piece mounting base further comprises a third spacer and a fourth spacer fixed on an inner side of the second outer baffle, the third spacer and the fourth spacer are provided with a plurality of second recesses used to separate and limit the dumbbell pieces fixed on the second dumbbell piece mounting base.

Further, each dumbbell piece further comprises a U-shaped groove extending from the mounting hole but not reaching the edge of the dumbbell piece, the open groove and the U-shaped groove are located at two opposite sides of the mounting hole, a width of the U-shaped groove is less than the diameter of the mounting hole, the open groove corresponds to the first spacer and the third spacer, the U-shaped groove corresponds to the second spacer and the fourth spacer.

According to the weight adjustable dumbbell provided by the present invention, the rotating mechanism is arranged on the outer side of the first counterweight part, and the weight adjustment of the dumbbell is realized through the cooperation of the transmission shaft, the first transmission sleeve and the second transmission sleeve. The operation is very convenient to bring better use experience to the user. In addition, the use of a planetary gear transmission mechanism as the rotating mechanism saves labor during the weight adjustment operation, which can further improve the user's experience.

DETAILED DESCRIPTION OF PREFERRED EMBODIMENTS

Specific embodiments of the present invention are described in further detail below in conjunction with the accompanying drawings. The following embodiments are used to illustrate the present invention, but are not used to limit the scope of the present invention.

Figure 1:
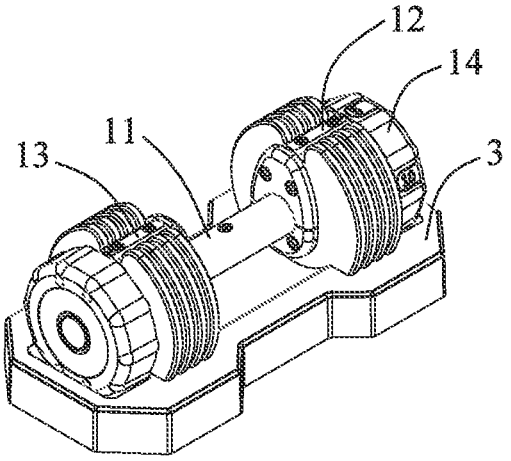
FIG. 1 is an isometric, assembled view of a weight adjustable dumbbell according to an embodiment of the present invention.
Figure 2:
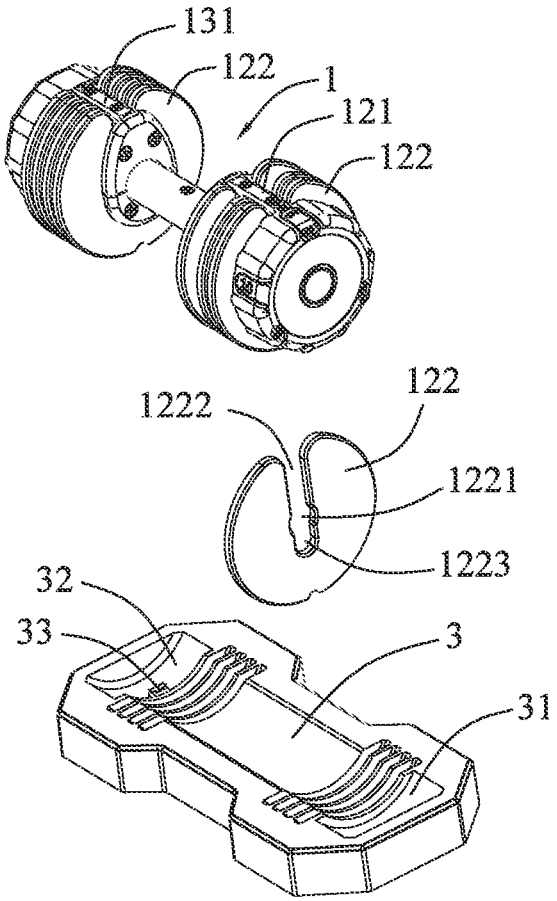
FIG. 2 is an isometric, exploded view of the weight adjustable dumbbell shown in FIG. 1.

As shown in FIGS. 1 to 2, in this embodiment, a weight adjustable dumbbell includes a handle assembly 1 and a base seat 3, and the base seat 3 is used to place the handle assembly 1.

Figure 3:
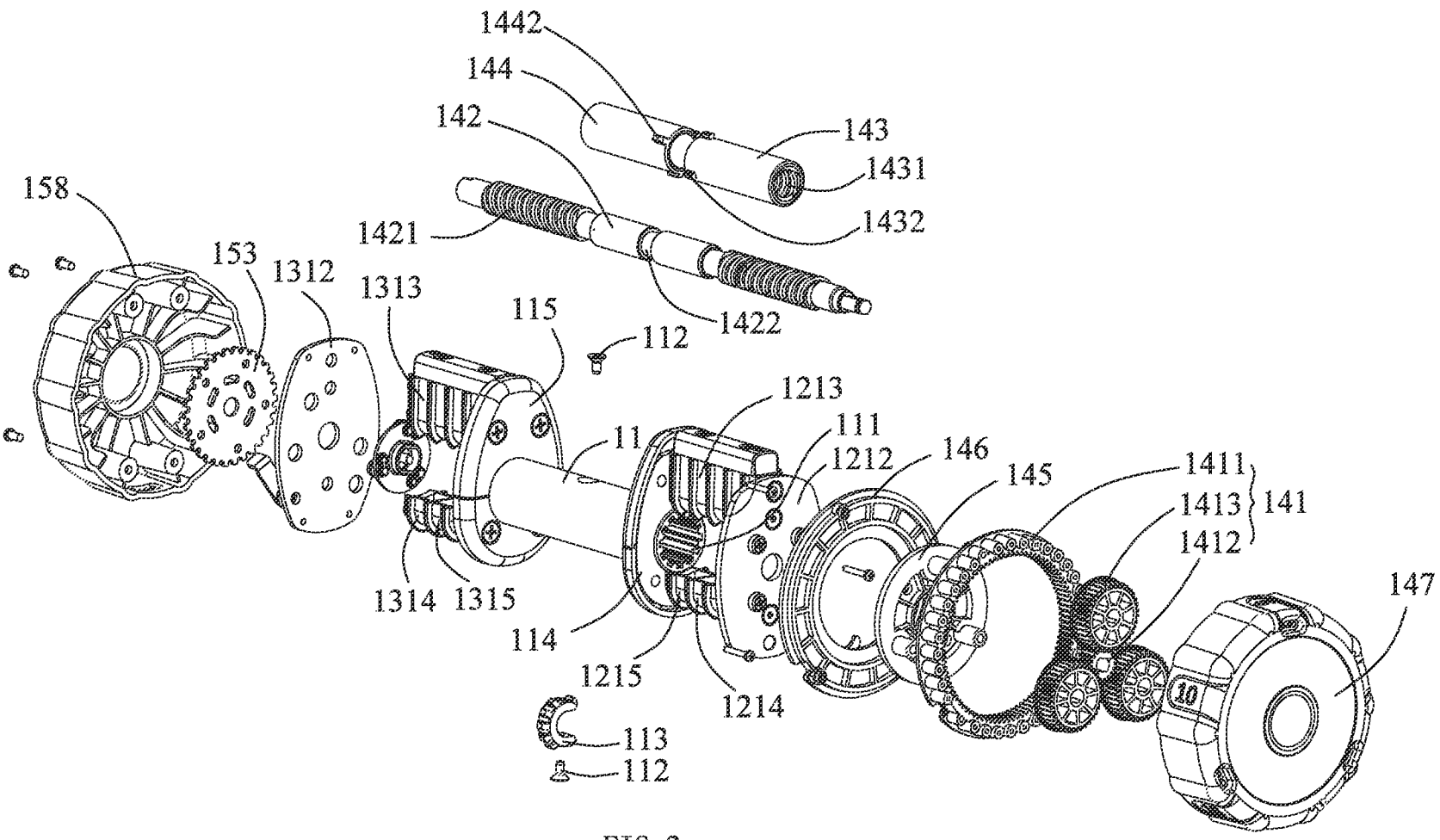
FIG. 3 is another isometric, exploded view of the weight adjustable dumbbell shown in FIG. 1 (the dumbbell pieces and the base seat are not shown).

As shown in FIGS. 1 to 3, in this embodiment, the handle assembly 1 includes a handle 11, a first counterweight part 12 and a second counterweight part 13 respectively arranged at two ends of the handle 11, an adjusting mechanism 14, a prompt mechanism 15 and a self-locking mechanism 16. In this embodiment, the first counterweight part 12 is a counterweight part located on a first end of the handle 11, and the second counterweight part 13 is a counterweight part located on a second end of the handle 11. Of course, the first counterweight part 12 may also be a counterweight part located on the second end of the handle 11, and the second counterweight part 13 is a counterweight part located on the first end of the handle 11, which may be adjusted according to the design requirements.

The handle 11 includes a handle main portion 110 and a first side plate 114 and a second side plate 115 respectively fixed to two ends of the handle main portion 110 by welding or screws. The handle main portion 110 is a hollow tubular structure, and a plurality of anti-rotation grooves 111 are provided inside the handle main portion 110 and extends axially through the handle 11 (including the first side plate 114 and the second side plate 115), such that the handle 11 forms a hollow structure.

The first counterweight part 12 includes a first dumbbell piece mounting base 121 and a plurality of dumbbell pieces 122 that can be fixed to the first dumbbell piece mounting base 121. The first dumbbell piece mounting base 121 includes a first outer baffle 1212 and a first spacer 1213 and a second spacer 1214 fixed on the inner side of the first outer baffle 1212. The first side plate 114 of the handle 11 is fixed on the inner sides of the first spacer 1213 and the second spacer 1214. The first spacer 1213 and the second spacer 1214 are provided with a plurality of first recesses 1215 (four in this embodiment) used to separate and limit the dumbbell pieces 122.

The second counterweight part 13 includes a second dumbbell piece mounting base 131 and a plurality of dumbbell pieces 122 that can be fixed to the second dumbbell piece mounting base 131. The second dumbbell piece mounting base 131 includes a second outer baffle 1312 and a third spacer 1313 and a fourth spacer 1314 fixed on the inner side of the second outer baffle 1312. The second side plate 115 of the handle 11 is fixed on the inner sides of the third spacer 1313 and the fourth spacer 1314. The third spacer 1313 and the fourth spacer 1314 are provided with a plurality of second recesses 1315 (four in this embodiment) used to separate and limit the dumbbell pieces 122.

As shown in FIG. 2, each dumbbell piece 122 has a circular shape, and a mounting hole 1221 is provided in the middle of each dumbbell piece 122. Two opposite sides of the mounting hole 1221 extend radially outward, such that an open groove 1222 extending from the mounting hole 1221 to the edge of the dumbbell piece 122 is formed on one side of the mounting hole 1221, and a U-shaped groove 1223 extending from the mounting hole 1221 but not reaching the edge of the dumbbell piece 122 is formed on the other side of the mounting hole 1221. The open groove 1222 and the U-shaped groove 1223 correspond to the first spacer 1213 (or the third spacer 1313) and the second spacer 1214 (or the fourth spacer 1314) respectively, which are used to separate and limit the dumbbell pieces 122 and avoid rotation of the dumbbell pieces 122. The width of the open groove 1222 and the U-shaped groove 1223 is less than the diameter of the mounting hole 1221.

As shown in FIG. 3, the adjusting mechanism 14 includes a planetary gear transmission mechanism 141, a transmission shaft 142, a first transmission sleeve 143, a second transmission sleeve 144, a planetary gear support 145, a ring gear support 146 and a first cover 147.

The planetary gear transmission mechanism 141 is arranged on the outer side of the first counterweight part 12 and includes a ring gear 1411, a sun gear 1412 and a planetary gear 1413 which are meshed with each other. The ring gear 1411 is used for operating, and the planetary gear 1413 is fixed on the first dumbbell piece mounting base 121 through the planetary gear support 145. The sun gear 1412 is fixedly connected with the transmission shaft 142, for example, the sun gear 1412 may be provided with a non-circular mounting hole, and one end of the transmission shaft 142 is inserted into the non-circular mounting hole of the sun gear 1412, such that the transmission shaft 142 is fixedly connected with the sun gear 1412. When rotating the ring gear 1411, the ring gear 1411 can drive the transmission shaft 142 to rotate through the sun gear 1412. The ring gear 1411 is fixed to the ring gear support 146 by screws. In this embodiment, the planetary gear transmission mechanism 141 serves as a rotating mechanism to drive the transmission shaft 142 to rotate, which is labor-saving and smoother than directly driving the transmission shaft 142 to rotate. Of course, in other embodiments, the transmission shaft 142 may also be directly driven to rotate, or other rotating mechanisms, such as an ordinary gear train, may be used to drive the transmission shaft 142 to rotate.

The first cover 147 is fixed to the ring gear 1411 by screws. The first cover 147 serves as an operating member of the adjusting mechanism 14, and the ring gear 1411 is driven to rotate by rotating the first cover 147. Further, a receiving space is formed between the first cover 147 and the ring gear support 146 to receive the planetary gear transmission mechanism 141 therein.

The outer periphery of the first cover 147 is provided with a plurality of scales to indicate the dumbbell weights corresponding to different positions of the first cover 147. In this embodiment, there are five scale values, which are 5 pounds, 10 pounds, 15 pounds, 20 pounds and 25 pounds. When the scales are located on the top, these scale values respectively represent the weight of no dumbbell piece, two dumbbell pieces, four dumbbell pieces, six dumbbell pieces and eight dumbbell pieces. Of course, the scales may also represent other weight units (such as kilograms), and the scale values may also be set at different quantities (such as 10, 20, etc.). The number of the scale values is also not limited to five, but generally corresponds to the number of the dumbbell pieces. The number of the scale values is equal to the number of the dumbbell pieces on one side plus 1 (because the initial value is the weight without dumbbell pieces).

Of course, in other embodiments, other structures may also be used as the operating member of the adjustment mechanism 14, such as an operating rod fixed on the ring gear 1411 (of course, it should extend out from the first cover 147), the scales are still set on the first cover 147 (the first cover 147 does not move), and the dumbbell weight is indicated by shifting the operating rod to the position of a corresponding scale. In this embodiment, the first cover 147 is used as the operating member of the adjusting mechanism 14, which can reduce components, simplify operation and make the scale be indicated clearer.

The center of the ring gear support 146 is provided with a through hole 1461, and the ring gear support 146 is sleeved around the outer periphery of the circular planetary gear support 145 by the through hole 1461, such that the ring gear support 146 can rotate around the planetary gear support 145.

Figure 6:
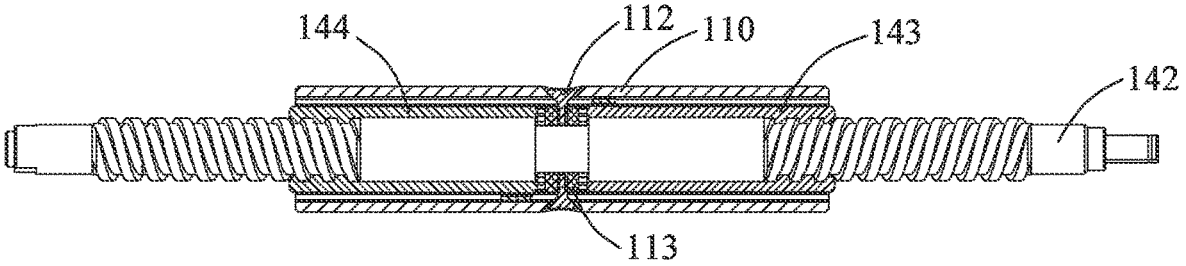
FIG. 6 is a cross-sectional view of some elements in the weight adjustable dumbbell shown in FIG. 1.

As shown in FIG. 3 and FIG. 6, the transmission shaft 142 is a long shaft, which runs through the first counterweight part 12 and the second counterweight part 13, and its outer diameter at the position corresponding to the dumbbell pieces 122 is less than the width of the open groove 1222 of each dumbbell piece 122. The first transmission sleeve 143 and the second transmission sleeve 144 are sleeved at two ends of the transmission shaft 142, and the transmission shaft 142 is meshed with the first transmission sleeve 143 and the second transmission sleeve 144, such that the transmission shaft 142 can drive the first transmission sleeve 143 and the second transmission sleeve 144 to move axially along the transmission shaft 142. In this embodiment, the transmission shaft 142 is a screw rod, the first transmission sleeve 143 and the second transmission sleeve 144 are screw nuts respectively, two ends of the screw rod are provided with an external thread 1421, and the interior of each screw nut is provided with an internal thread 1431 matched with the external thread 1421 (but the thread directions of the two internal threads 1431 are opposite). The transmission shaft 142 drives the first transmission sleeve 143 and the second transmission sleeve 144 to move axially along the transmission shaft 142 through the cooperation of the internal thread 1431 and the external thread 1421. In other embodiments, other structures may also be used to make the transmission shaft 142 drive the first transmission sleeve 143 and the second transmission sleeve 144 to move axially along the transmission shaft 142, for example, a spiral groove is cooperated with a projecting pin, but the use of internal and external threads matched with each other in this embodiment is smoother for rotation.

The outer diameter of the first transmission sleeve 143 and the second transmission sleeve 144 is greater than the width of the open groove 1222 but less than the diameter of the mounting hole 1221. When driven by the transmission shaft 142 to move axially in approaching directions or in opposite directions (since the thread directions of the two internal threads 1431 are opposite), distal ends of the first transmission sleeve 143 and the second transmission sleeve 144 can insert into (when moving in opposite directions) or leave (when moving in approaching directions) the mounting holes 1221 of portion or all of the dumbbell pieces 122, to thereby adjust the number of the dumbbell pieces 122 fixed on the first transmission sleeve 143 and the second transmission sleeve 144, such that the dumbbell pieces 122 are fixed on or detached from the first counterweight part 12 and the second counterweight part 13, thereby adjusting the weight of the dumbbell (the specific adjusting will be described later).

In this embodiment, the transmission ratio between the ring gear 1411, the sun gear 1412, the transmission shaft 142 and the first transmission sleeve 143 and the second transmission sleeve 144 is set by calculation, such that when the ring gear 1411 rotates one turn, each of the first transmission sleeve 143 and the second transmission sleeve 144 moves axially five times the distance between the centers of two adjacent dumbbell pieces 122 (it can also be other multiples, which corresponds to the number of the dumbbell pieces, in this embodiment, the multiple is equal to the number of the dumbbell pieces on one side plus 1). In other embodiments, it is not limited to one turn corresponding to the number of the dumbbell pieces, but other corresponding relationships can also be set, for example, when the ring gear 1411 rotates half turn or ⅔ turn, the first transmission sleeve 143 and the second transmission sleeve 144 each move axially five times the distance between the centers of two adjacent dumbbell pieces 122. In this embodiment, the setting of one turn corresponding to the number of the dumbbell pieces 122 is easier to operate (the spacing between the five scales is equal) and more convenient (the rotation range is large).

In order to prevent the first transmission sleeve 143 and the second transmission sleeve 144 from rotating with the transmission shaft 142, the first transmission sleeve 143 and the second transmission sleeve 144 are also provided with an anti-rotation structure, to make the first transmission sleeve 143 and the second transmission sleeve 144 move axially under the driving of the transmission shaft 142 due to the limitation of the anti-rotation structure. In this embodiment, the anti-rotation structure includes anti-rotation strips 1432, 1442 respectively provided on the outer periphery of the first transmission sleeve 143 and the second transmission sleeve 143. Through the cooperation between the anti-rotation grooves 111 of the handle 11 and the anti-rotation strips 1432, 1442, the first transmission sleeve 143 and the second transmission sleeve 144 are prevented from rotating with the transmission shaft 142.

An annular groove 1422 is also provided at the middle position of the transmission shaft 142, the handle 11 is provided with a semicircular stopper 113 fixed to the handle main portion 110 through screws 112 at the position corresponding to the annular groove 1422, and the semicircular stopper 113 is engaged in the annular groove 1422 of the transmission shaft 142, such that the transmission shaft 142 can rotate relative to the handle 11 but cannot move axially.

Figure 4:
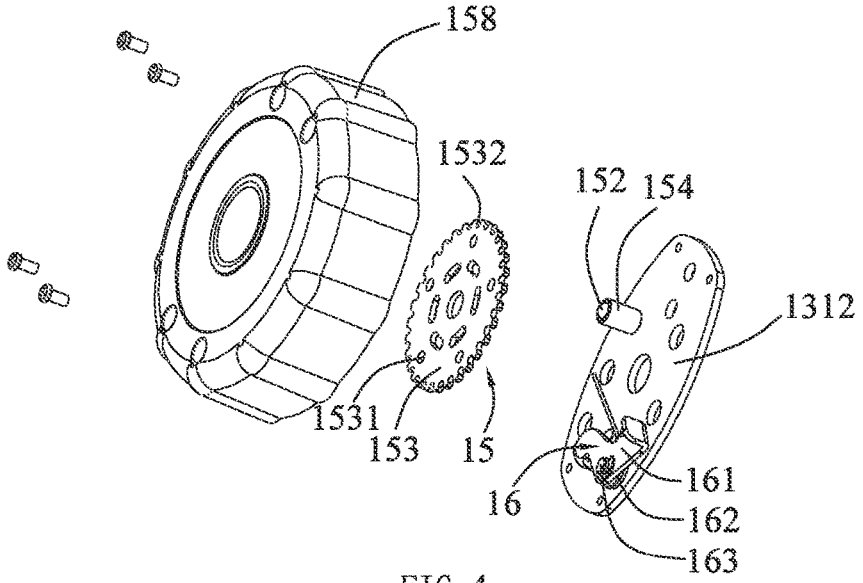
FIG. 4 is an isometric, exploded view of the prompt mechanism and the self-locking mechanism in the weight adjustable dumbbell shown in FIG. 1.

As shown in FIG. 3 and FIG. 4, the prompt mechanism 15 includes a fixed element (in this embodiment, the second outer baffle 1312 of the second dumbbell piece mounting base 131 is used as the fixed element), an elastic element (in this embodiment, a spring), a ball 152 and a rotating element 153. The rotating element 153 is fixed to the transmission shaft 142 and rotates with the transmission shaft 142. The rotating element 153 is a circular plate with a plurality of locking grooves 1532 evenly distributed around a periphery thereof. The rotating element 153 is provided with a plurality of circular holes 1531 (five in this embodiment), and the center of a circle formed by the centers of the circular holes 1531 is located at the axis of the transmission shaft 142. The fixed element 1312 is fixedly provided with a tube 154 corresponding to the circular hole 1531, and the ball 152 is installed to the outer end of the tube 154. The elastic element is received in the tube 154 and located between the ball 152 and the fixed element 1312, and pushes the ball 152 to move outward from the outer end of the tube 154, such that the ball 152 is movably installed on the fixed element 1312. The tube 154 corresponds to the rotation path of the circular holes 1531, and the ball 152 is located on the circle formed by the centers of the circular holes 1531 (that is, on the rotation path of the circular holes 1531). A suitable position relationship is set between the ball 152 and the circular holes 1531, such that when the dumbbell is adjusted to a predetermined weight, the ball 152 is just located at the position of one of the circular holes 1531, and is pushed by the elastic element to engage into the circular hole 1531, so as to collide with the rotating element 153 and make a sound to give a prompt to the user.

Figure 5:
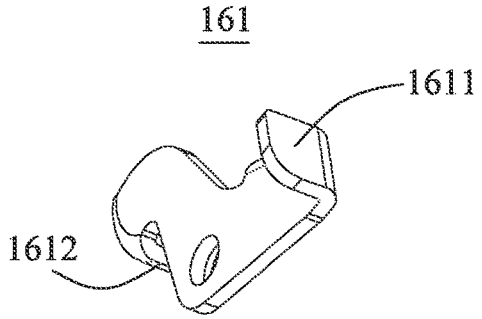
FIG. 5 is an isometric view of the locking member in the self-locking mechanism shown in FIG. 4.

The self-locking mechanism 16 includes a locking member 161, an elastic member 162 (a torsion spring in this embodiment) and a mounting member 163. As shown in FIG. 5, the locking member 161 includes an upper locking portion 1611 and a lower resisting portion 1612. The locking member 161 is rotatably mounted on the fixed element 1312 through the mounting member 163 which includes a pin and a retaining ring in this embodiment (of course, other mounting structures may also be adopted). The elastic member 162 is arranged between the locking member 161 and the fixed element 1312. The locking member 161 and the elastic member 162 are connected with each other, such that the elastic member 162 can drive the upper locking portion 1611 to rotate inward to be engaged with the locking groove 1532 of the rotating element 153. At this time, the rotating element 153 is locked and cannot rotate, such that the transmission shaft 142 and the first cover 147 also cannot rotate, to ensure that the first cover 147 will not be rotated due to misoperation during the use of the dumbbell, thereby ensuring the operation safety. When the handle assembly 1 is placed on the base seat 3, the lower resisting portion 1612 is resisted by a protrusion 33 (as shown in FIG. 2) formed on the base seat 3 to drive the upper locking portion 1611 to rotate outward, such that the upper locking portion 1611 is disengaged from the locking groove 1532 of the rotating element 153. At this time, the rotating element 153 is released and can rotate, and then the transmission shaft 142 and the first cover 147 also can rotate, such that the weight adjustment operation can be carried out.

The outer side of the prompt mechanism 15 is further provided with a second cover 158 for covering around the various components of the prompt mechanism 15 and the self-locking mechanism 16 to protect these components.

As shown in FIG. 2, one end of the base seat 3 is provided with a first receiving groove 31 corresponding to the planetary gear transmission mechanism 141 to provide space for accommodating the planetary gear transmission mechanism 141 and for convenient operation, and the other end of the base seat 3 is provided with a second receiving groove 32 corresponding to the prompt mechanism 15 to provide space for accommodating the prompt mechanism 15.

The following describes how to adjust the weight. When the first transmission sleeve 143 and the second transmission sleeve 144 are in the innermost positions, by lifting the handle assembly 1, all the dumbbell pieces 122 will remain on the base seat 3. At this time, the dumbbell weight is 5 pounds, and the 5-pound scale on the first cover 147 is located at the top position. When it is necessary to add to 10 pounds, the first cover 147 is rotated to the 10-pound position (that is, the 10-pound scale is at the top position). At this time, the first cover 147 drives the ring gear 1411 to rotate, the ring gear 1411 drives the transmission shaft 142 to rotate, and the transmission shaft 142 drives the first transmission sleeve 143 and the second transmission sleeve 144 to move axially outward in opposite directions for a preset distance respectively (the preset distance is the distance between the centers of two adjacent dumbbell pieces). At this time, the first transmission sleeve 143 and the second transmission sleeve 144 are located in the centers of the innermost two dumbbell pieces 122. When rotating in place, the ball 152 in the prompt mechanism 15 just falls into one of the circular holes 1531 to produce a sound. When the handle assembly 1 is lifted, the innermost two dumbbell pieces 122 are fixed on the handle assembly 1, while the other dumbbell pieces 122 remain on the base seat 3. The adjustment of other weights is the same and will not be described repeatedly. The above-described adjusting is to increase the weight. If the user wants to reduce the weight, the first cover 147 is rotated in a reverse direction, and at this time, the first transmission sleeve 143 and the second transmission sleeve 144 move axially inward in approaching directions respectively, such that the first transmission sleeve 143 and the second transmission sleeve 144 leave the centers of the dumbbell pieces 122, and the dumbbell pieces 122 stay in the base seat 3 when lifting the handle assembly 1.

Compared with the prior art, according to the weight adjustable dumbbell of this embodiment, the rotating mechanism is arranged on the outer side of the first counterweight part, and the weight adjustment of the dumbbell is realized through the cooperation of the transmission shaft, the first transmission sleeve and the second transmission sleeve. The operation is very convenient to bring better use experience to the user. In addition, the use of the planetary gear transmission mechanism as the rotating mechanism saves labor during the weight adjustment operation, which can further improve the user's experience.

In this description, the azimuth or positional relationship indicated by the terms "up", "down", "front", "back", "left", "right", "top", "bottom", "inside", "outside", "vertical", "horizontal" is based on the azimuth or positional relationship shown in the accompanying drawings, only for the sake of clarity and convenience of description of the technical solution. Therefore, it cannot be understood as a limitation of the present invention.

In this description, the terms "include", "comprise", or any other variation thereof are intended to cover non-exclusive inclusion, including not only those elements listed, but also other elements not explicitly listed.

The above is only the specific embodiments of the present invention, but the protection scope of the present invention is not limited to this. Any person skilled in the technical field can easily think of changes or replacements within the technical scope disclosed by the present invention, which should be covered by the protection scope of the present invention. Therefore, the protection scope of the present invention shall be subject to the appended claims.

What is claimed is:

1. A weight adjustable dumbbell comprising a handle assembly, wherein the handle assembly comprises a handle and a first counterweight part and a second counterweight part respectively arranged at two ends of the handle, each of the first counterweight part and the second counterweight part comprises a plurality of dumbbell pieces, each dumbbell piece comprises a mounting hole and an open groove extending from the mounting hole to an edge of the dumbbell piece, a width of the open groove is less than a diameter of the mounting hole;

the weight adjustable dumbbell further comprises an adjusting mechanism, the adjusting mechanism comprises a rotating mechanism, a transmission shaft, a first transmission sleeve and a second transmission sleeve, the rotating mechanism is arranged on an outer side of the first counterweight part, the rotating mechanism is fixedly connected with the transmission shaft to drive the transmission shaft to rotate;

an outer diameter of the first transmission sleeve and the second transmission sleeve is greater than the width of the open groove but less than the diameter of the mounting hole, the first transmission sleeve and the second transmission sleeve are sleeved on the transmission shaft, and the transmission shaft is meshed with the first transmission sleeve and the second transmission sleeve, such that the transmission shaft can drive the first transmission sleeve and the second transmission sleeve to move axially along the transmission shaft and cause distal ends of the first transmission sleeve and the second transmission sleeve to insert into or leave the mounting holes of a portion of or all of the dumbbell pieces, whereby the dumbbell pieces are fixed on or detached from the first counterweight part and the second counterweight part.

2. The weight adjustable dumbbell according to claim 1, wherein the transmission shaft is a screw rod, the first transmission sleeve and the second transmission sleeve are screw nuts respectively, two ends of the screw rod are provided with an external thread, an interior of each of the screw nuts is provided with an internal thread matched with the external thread, wherein the thread directions of the two internal threads are opposite.

3. The weight adjustable dumbbell according to claim 1, wherein a planetary gear transmission mechanism is used as the rotating mechanism, the planetary gear transmission mechanism comprises a ring gear, a sun gear and a planetary gear which are meshed with each other, the ring gear is used for operating, the sun gear is fixedly connected with the transmission shaft, such that the ring gear drives the transmission shaft to rotate through the sun gear.

4. The weight adjustable dumbbell according to claim 3, wherein the adjusting mechanism further comprises an operating member, the operating member is fixedly connected with the ring gear, such that the ring gear is driven to rotate by rotating the operating member.

5. The weight adjustable dumbbell according to claim 4, wherein an outer periphery of the operating member is provided with a plurality of scales to indicate the dumbbell weights corresponding to different positions of the operating member.

6. The weight adjustable dumbbell according to claim 3, wherein when the ring gear rotates one turn, the first transmission sleeve and the second transmission sleeve axially move multiples of a distance between the centers of two adjacent dumbbell pieces.

7. The weight adjustable dumbbell according to claim 1, wherein the handle is a hollow structure, the transmission shaft, the first transmission sleeve and the second transmission sleeve are located inside the handle.

8. The weight adjustable dumbbell according to claim 7, wherein the first transmission sleeve and the second transmission sleeve are provided with an anti-rotation structure, such that when driven by the transmission shaft, the first transmission sleeve and the second transmission sleeve can move only axially along the transmission shaft due to the limitation of the anti-rotation structure.

9. The weight adjustable dumbbell according to claim 8, wherein the anti-rotation structure comprises anti-rotation strips respectively provided on an outer periphery of the first transmission sleeve and the second transmission sleeve, the handle is internally provided with anti-rotation grooves, the first transmission sleeve and the second transmission sleeve are prevented from rotating with the transmission shaft through the cooperation between the anti-rotation grooves and the anti-rotation strips.

10. The weight adjustable dumbbell according to claim 9, wherein an annular groove is provided at a middle position of the transmission shaft, a stopper is fixed to the handle, and the stopper is engaged in the annular groove, such that the transmission shaft can rotate relative to the handle but cannot move axially.

11. The weight adjustable dumbbell according to claim 1, wherein the weight adjustable dumbbell further comprises a prompt mechanism arranged on an outer side of the second counterweight part, the prompt mechanism comprises a fixed element, an elastic element, a ball and a rotating element, the rotating element is fixed to the transmission shaft and rotates with the transmission shaft, the rotating element is provided with a plurality of holes, the ball is located on a rotation path of the holes, the ball is pushed by the elastic element and movably installed on the fixed element, when the dumbbell is adjusted to a predetermined weight, the ball is pushed into one of the holes by the elastic element.

12. The weight adjustable dumbbell according to claim 11, wherein the fixed element is fixedly provided with a tube, the ball is installed to an outer end of the tube, the elastic element is received in the tube and located between the ball and the fixed element, and pushes the ball to move outward from the outer end of the tube, such that the ball is movably installed on the fixed element.

13. The weight adjustable dumbbell according to claim 11, wherein the first counterweight part comprises a first dumbbell piece mounting base for fixing the dumbbell pieces thereon, the first dumbbell piece mounting base comprises a first outer baffle;

the second counterweight part comprises a second dumbbell piece mounting base for fixing the dumbbell pieces thereon, the second dumbbell piece mounting base comprises a second outer baffle;

the second outer baffle is used as the fixed element.

14. The weight adjustable dumbbell according to claim 13, wherein the first dumbbell piece mounting base further comprises a first spacer and a second spacer fixed on an inner side of the first outer baffle, the first spacer and the second spacer are provided with a plurality of first recesses used to separate and limit the dumbbell pieces fixed on the first dumbbell piece mounting base;

the second dumbbell piece mounting base further comprises a third spacer and a fourth spacer fixed on an inner side of the second outer baffle, the third spacer and the fourth spacer are provided with a plurality of second recesses used to separate and limit the dumbbell pieces fixed on the second dumbbell piece mounting base.

15. The weight adjustable dumbbell according to claim 14, wherein each dumbbell piece further comprises a U-shaped groove extending from the mounting hole but not reaching the edge of the dumbbell piece, the open groove and the U-shaped groove are located at two opposite sides of the mounting hole, a width of the U-shaped groove is less than the diameter of the mounting hole, the open groove corresponds to the first spacer and the third spacer, the U-shaped groove corresponds to the second spacer and the fourth spacer.

16. The weight adjustable dumbbell according to claim 1, wherein the weight adjustable dumbbell further comprises a base seat for placing the handle assembly and a self-locking mechanism arranged on an outer side of the second counterweight part, the self-locking mechanism comprises a rotating element, a locking member and an elastic member, the rotating element is fixed to the transmission shaft and rotates with the transmission shaft, the rotating element is a circular plate with a plurality of locking grooves distributed around a periphery thereof, the locking member comprises an upper locking portion and a lower resisting portion, the locking member is rotatably mounted on a fixed element, the elastic member is arranged between the locking member and the fixed element, such that the elastic member can drive the upper locking portion to rotate inward to be engaged with the locking groove;

when the handle assembly is placed on the base seat, the lower resisting portion is resisted by the base seat to drive the upper locking portion to rotate outward, such that the upper locking portion is disengaged from the locking groove.

17. The weight adjustable dumbbell according to claim 16, wherein the first counterweight part comprises a first dumbbell piece mounting base for fixing the dumbbell pieces thereon, the first dumbbell piece mounting base comprises a first outer baffle;

the second counterweight part comprises a second dumbbell piece mounting base for fixing the dumbbell pieces thereon, the second dumbbell piece mounting base comprises a second outer baffle;

the second outer baffle is used as the fixed element.

18. The weight adjustable dumbbell according to claim 17, wherein the first dumbbell piece mounting base further comprises a first spacer and a second spacer fixed on an inner side of the first outer baffle, the first spacer and the second spacer are provided with a plurality of first recesses used to separate and limit the dumbbell pieces fixed on the first dumbbell piece mounting base;

the second dumbbell piece mounting base further comprises a third spacer and a fourth spacer fixed on an inner side of the second outer baffle, the third spacer and the fourth spacer are provided with a plurality of second recesses used to separate and limit the dumbbell pieces fixed on the second dumbbell piece mounting base.

19. The weight adjustable dumbbell according to claim 18, wherein each dumbbell piece further comprises a U-shaped groove extending from the mounting hole but not reaching the edge of the dumbbell piece, the open groove and the U-shaped groove are located at two opposite sides of the mounting hole, a width of the U-shaped groove is less than the diameter of the mounting hole, the open groove corresponds to the first spacer and the third spacer, the U-shaped groove corresponds to the second spacer and the fourth spacer.

* * * * *